US009281606B2

(12) United States Patent
Mori

(10) Patent No.: US 9,281,606 B2
(45) Date of Patent: Mar. 8, 2016

(54) CONNECTOR FOR AUTOMOBILE WIRING HARNESS

(75) Inventor: Shigeo Mori, Makinohara (JP)

(73) Assignee: Yazaki Corporation, Tokyo (JP)

( * ) Notice: Subject to any disclaimer, the term of this patent is extended or adjusted under 35 U.S.C. 154(b) by 22 days.

(21) Appl. No.: 14/002,256

(22) PCT Filed: Feb. 29, 2012

(86) PCT No.: PCT/JP2012/001370

§ 371 (c)(1),
(2), (4) Date: Aug. 29, 2013

(87) PCT Pub. No.: WO2012/120834

PCT Pub. Date: Sep. 13, 2012

(65) Prior Publication Data

US 2013/0337693 A1 Dec. 19, 2013

(30) Foreign Application Priority Data

Mar. 4, 2011 (JP) ..... 2011-047207

(51) Int. Cl.

| | |
|---|---|
| ***H01R 24/00*** | (2011.01) |
| ***H01R 13/516*** | (2006.01) |
| ***H01R 13/52*** | (2006.01) |
| *H01R 43/20* | (2006.01) |

(52) U.S. Cl.

CPC ..... *H01R 13/516* (2013.01); *H01R 13/521* (2013.01); *H01R 13/5205* (2013.01); *H01R 43/20* (2013.01)

(58) Field of Classification Search

CPC ... H01R 13/426; H01R 13/40; H01R 13/4367
USPC ..... 439/271, 884, 83, 733.1
See application file for complete search history.

(56) References Cited

U.S. PATENT DOCUMENTS 4,643,506 A * 2/1987 Kobler ..... H01R 13/5205 439/271
7,357,672 B2 * 4/2008 Montena ..... H01R 9/0524 174/59

(Continued)

FOREIGN PATENT DOCUMENTS

GB 2187896 A 9/1987
JP S62147277 U 9/1987

(Continued)

OTHER PUBLICATIONS

International Search Report and Written Opinion dated May 23, 2012, issued for PCT/JP2012/001370.

(Continued)

*Primary Examiner* — Abdullah Riyami
*Assistant Examiner* — Nader J Alhawamdeh
(74) *Attorney, Agent, or Firm* — Locke Lord LLP; James E. Armstrong, IV; Brian S. Matross

(57) ABSTRACT

A connector includes: a terminal; a housing; a rear holder; and a rubber plug. A terminal receiving chamber of the housing is provided with: a first receiving portion receiving a wire connecting portion, an electric wire connected to the wire connecting portion, and a rubber plug; a second receiving portion; and a step wall interposed between the first and second receiving portions and allowing a flange portion formed on the wire connecting portion to abut on the step wall. The rubber plug is composed of a ring-shaped packing attached to the electric wire and keeping a space between an outer peripheral wall of the electric wire and an inner wall of the first receiving portion watertight, and a resin member. The resin member is provided with a buried portion buried in the packing, and a cylinder portion extended from the buried portion and interposed between the flange and the packing.

2 Claims, 6 Drawing Sheets

(56) References Cited

U.S. PATENT DOCUMENTS

| | | | | |
|---|---|---|---|---|
| 8,241,061 | B2 * | 8/2012 | Chazottes | H01R 13/5205 439/272 |
| 2006/0154522 | A1 * | 7/2006 | Bernhart | H01R 13/64 439/587 |
| 2007/0149011 | A1 * | 6/2007 | Kent | H01R 13/508 439/120 |
| 2011/0059659 | A1 | 3/2011 | Matsumoto et al. | |
| 2013/0330952 | A1 * | 12/2013 | Mori | H01R 13/426 439/271 |

FOREIGN PATENT DOCUMENTS

| | | | | |
|---|---|---|---|---|
| JP | 2010-055809 | A | 3/2010 | |
| JP | WO 2010024362 | A1 * | 3/2010 | H01R 13/426 |
| WO | WO-2010/024362 | A1 | 3/2010 | |
| WO | WO 2010024362 | A1 * | 3/2010 | |

OTHER PUBLICATIONS

Notification of Reasons for Refusal, issued in corresponding Japanese Patent Application No. JP 2011-047207, dated Dec. 9, 2014.

* cited by examiner

CONNECTOR FOR AUTOMOBILE WIRING HARNESS

TECHNICAL FIELD

This invention relates to a connector as a component of a wiring harness routed in a vehicle or the like.

BACKGROUND ART

Various electronic devices are mounted on a vehicle. A wiring harness is routed in the vehicle for transmitting electric power and control signals to these various electronic devices. This wiring harness includes: a plurality of electric wires; and a connector (see PLT 1). FIG. 5 is a sectional view showing a conventional connector. FIG. 6 is an exploded view showing the connector shown in FIG. 5. FIG. 7 is a perspective view showing a terminal and the like of the connector shown in FIG. 5.

As shown in FIGS. 5 to 7, a connector 301 includes: a plurality of terminals 302; a synthetic-resin-made housing 303 having a plurality of terminal receiving chambers 314 respectively receiving the terminals 302; a rear holder 304 attached to an end portion of the housing 303 for preventing the terminals 302 from falling out of the terminal receiving chambers 314; a plurality of rubber plugs 305 respectively pressed into the terminal receiving chambers 314; a plurality of spacers 306 respectively received in the terminal receiving chambers 314; and a plurality of packings 307 respectively attached to the terminals 302. In FIGS. 5 and 6, only each ones of the terminals 302, the rubber plugs 305, the spacers 306, and the packings 307 are shown and the others are omitted.

The terminal 302 is made of conductive metal. The terminal 302 is provided with a cylindrical electric contact portion 311 connected to a terminal of a not-shown mating connector, and a cylindrical wire connecting portion 310 connected to a core wire 309 of an electric wire 308. Further, the wire connecting portion 310 is provided with a flange portion 312 projected from an outer peripheral wall of the wire connecting portion 310 for abutting on a step wall 317 formed on the terminal receiving chambers 314. Further, the electric contact portion 311 and the wire connecting portion 310 are arranged coaxially.

The electric contact portion 311 is elastically deformable so that inner and outer diameters can be expanded and contracted. When the terminal of the mating connector is inserted into an inside of the electric contact portion 311, and the electric contact portion 311 is elastically deformed, the electric contact portion 311 is electrically connected to the terminal of the mating connector.

When the core wire 309 of the electric wire 308 is inserted into an inside of the wire connecting portion 310, and the wire connecting portion 310 is plastically deformed so that inner and outer diameters are contracted, namely, the wire connecting portion 310 is swaged, the wire connecting portion 310 is electrically connected to the core wire 309 of the electric wire 308. Further, the flange portion 312 is provided on an end of the wire connecting portion 310 near the electric contact portion 311. Further, a groove 313 is provided along a whole outer peripheral wall of the flange portion 312.

Each terminal receiving chamber 314 is a straight extended space. Each terminal receiving chamber 314 is provided with: a first receiving portion 315 receiving the wire connecting portion 310, an end of the electric wire 308 connected to the wire connecting portion 310, the rubber plug 305 attached to an outer periphery of the electric wire 308, and the spacer 306; a second receiving portion 316 continued to the first receiving portion 315; and a step wall 317 formed between the first receiving portion 315 and the second receiving portion 316. Sectional shapes of the first receiving portion 315 and the second receiving portion 316 are circular. Further, an inner diameter of the second receiving portion 316 is smaller than an inner diameter of the first receiving portion 315. Further, a connector housing of a not-shown mating connector is fitted with a left end of the housing 303 in FIG. 5.

The rear holder 304 is attached to an end of the housing 303 at a side away from the mating connector. The rear holder 304 is provided with a plurality of through-holes 318 each through which the electric wire 308 attached to the terminal 302 is inserted.

The rubber plug 305 is composed of a ring-shaped packing 319 made of elastically deformable synthetic resin such as gum, and a buried member 320 made of synthetic resin which is harder than the packing 319 and hardly elastically deformable. This rubber plug 305 is pressed into the first receiving portion 315 while the electric wire 308 is inserted through an inside of the rubber plug 305, and keeps an outer peripheral wall of the electric wire 308 and an inner wall of the 315 watertight.

The spacer 306 is formed in a tubular shape having a notched circular section. This spacer 306 is received in the first receiving portion 315 while the wire connecting portion 310 and the electric wire 308 are arranged in an inside of the spacer 306, and the spacer 306 is interposed between the flange portion 312 and the rubber plug 305. Further, a width of the notch of the spacer 306 is larger than diameters of the wire connecting portion 310 and the electric wire 308.

The packing 307 is made of elastically deformable synthetic resin such as rubber, and formed in a ring shape. The packing 307 is attached to the flange portion 312 in a manner that the packing 307 is received in the groove 313. This packing 307 keeps an outer peripheral wall of the flange portion 312 and an inner wall of the first receiving portion 315 watertight.

The connector 301 having the above described structure is assembled as follows. First, the packing 307 is attached to the terminal 302, and the electric wire 308 is inserted through an inside of the rubber plug 305. Then, the core wire 309 of the electric wire 308 is inserted into the wire connecting portion 310, and the wire connecting portion 310 is swaged to attach the electric wire 308 to the terminal 302. Then, while the spacer 306 is held between the flange portion 312 and the rubber plug 305, these terminal 302, packing 307, spacer 306, rubber plug 305 and electric wire 308 are inserted into the terminal receiving chamber 314. Then, the rear holder 304 is attached to the housing 303. Thus, the connector 301 is assembled. This assembled connector 301 is fitted with the mating connector, and works as a component of the wiring harness routed in a vehicle.

Owing to the flange portion 312 allowed to abut on the step wall 317 of the terminal receiving chamber 314 and the spacer 306 interposed between the flange portion 312 and the rubber plug 305, such a connector 301 can fix the terminal 302 to the housing 303 without providing a locking arm on the housing for being locked with the terminal 302. Thereby, the housing 303 can be downsized.

CITATION LIST

Patent Literature

[PLT1]
JP, A, 2010-55809

SUMMARY OF INVENTION

Technical Problem

However, in the conventional connector 301 described above, there is a problem as follows. Because the spacer 306 is formed in a notched circular sectional shape, when the components are assembled to the housing 303, the spacer 306 is easy to fall out of between the flange portion 312 and the rubber plug 305. Therefore, there is a problem that assembling workability is not good.

Accordingly, an object of the present invention is to provide a connector of good assembling workability able to prevent components from falling out when the components are assembled to a housing.

Solution to Problem

For attaining the object, according to the invention claimed in claim 1, there is provided a connector comprising:

a terminal;

a housing provided with a terminal receiving chamber for receiving the terminal;

a rear holder attached to an end of the housing to prevent the terminal from falling out of the terminal receiving chamber; and a rubber plug pressed into the terminal receiving chamber, wherein the terminal is provided with an electric contact portion connected to a mating terminal, and a wire connecting portion connected to an electric wire, wherein the terminal receiving chamber is provided with: a first receiving portion receiving the wire connecting portion, an end of the electric wire connected to the wire connecting portion, and the rubber plug; a second receiving portion continued to the first receiving portion; and a step wall formed between the first receiving portion and the second receiving portion, wherein the wire connecting portion is provided with a flange portion projected from an outer peripheral wall of the wire connecting portion and allowed to abut on the step wall, wherein the rubber plug is composed of a ring-shaped packing attached to an outer periphery of the electric wire and keeping a space between an outer peripheral wall of the electric wire and an inner wall of the first receiving portion watertight, and a resin member, wherein the resin member is provided with a buried portion at least a part of which is buried in the packing, and a cylinder portion extended in a cylindrical shape from the buried portion made by insert molding, and wherein the cylinder portion is interposed between the flange and the packing.

According to the invention claimed in claim 2, there is provided the connector as claimed in claim 1, further comprising:

a second packing attached to an outer peripheral wall of the flange portion, and keeping a space between the outer peripheral wall of the flange portion and the inner wall of the first receiving portion watertight.

[Advantageous Effects of Invention]

According to the invention claimed in claim 1, the rubber plug is composed of a ring-shaped packing attached to an outer periphery of the electric wire and keeping a space between an outer peripheral wall of the electric wire and an inner wall of the first receiving portion watertight, and a resin member. Further, the resin member is provided with a buried portion at least a part of which is buried in the packing, and a cylinder portion extended in a cylindrical shape from the buried portion made by insert molding. Further, the cylinder portion is interposed between the flange and the packing. Therefore, the spacer which is easy to fall out when components are assembled to the housing in the conventional product becomes needless. Therefore, a connector of good assembling workability able to prevent components from falling out when the components are assembled to a housing with a small number of components can be provided. Further, because the number of components of this connector is small, not only the assembling workability but also disassembling workability can be improved.

According to the invention claimed in claim 2, the connector further includes a second packing attached to an outer peripheral wall of the flange portion, and keeping a space between the outer peripheral wall of the flange portion and the inner wall of the first receiving portion watertight. Therefore, a connector having good assembling workability and high waterproof property can be provided.

DESCRIPTION OF EMBODIMENTS

A connector according to an embodiment of the present invention will be explained with reference to FIGS. 1 to 4.

Figure 1:
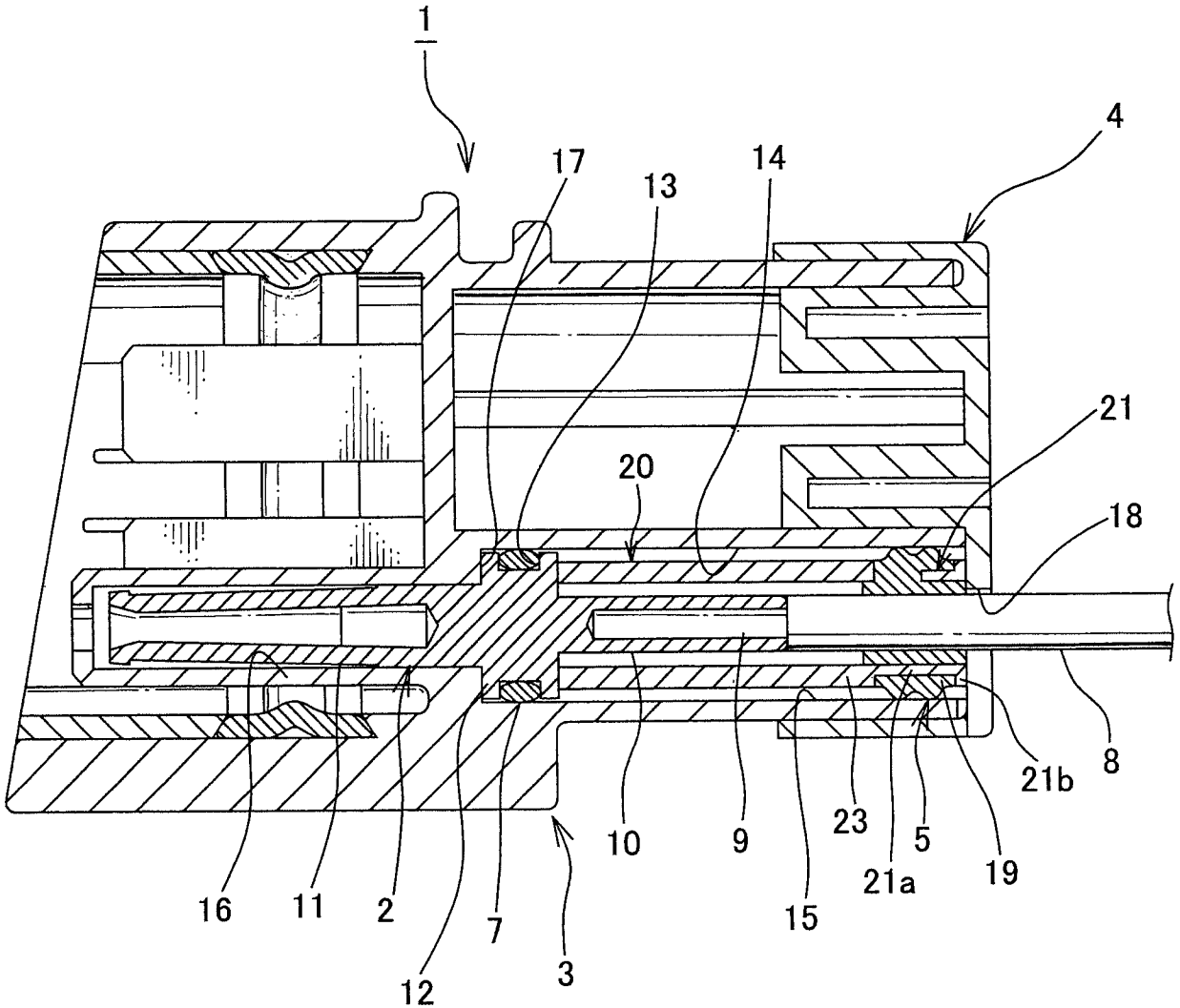
FIG. 1 is a sectional view showing a connector according to an embodiment of the present invention.
Figure 2:
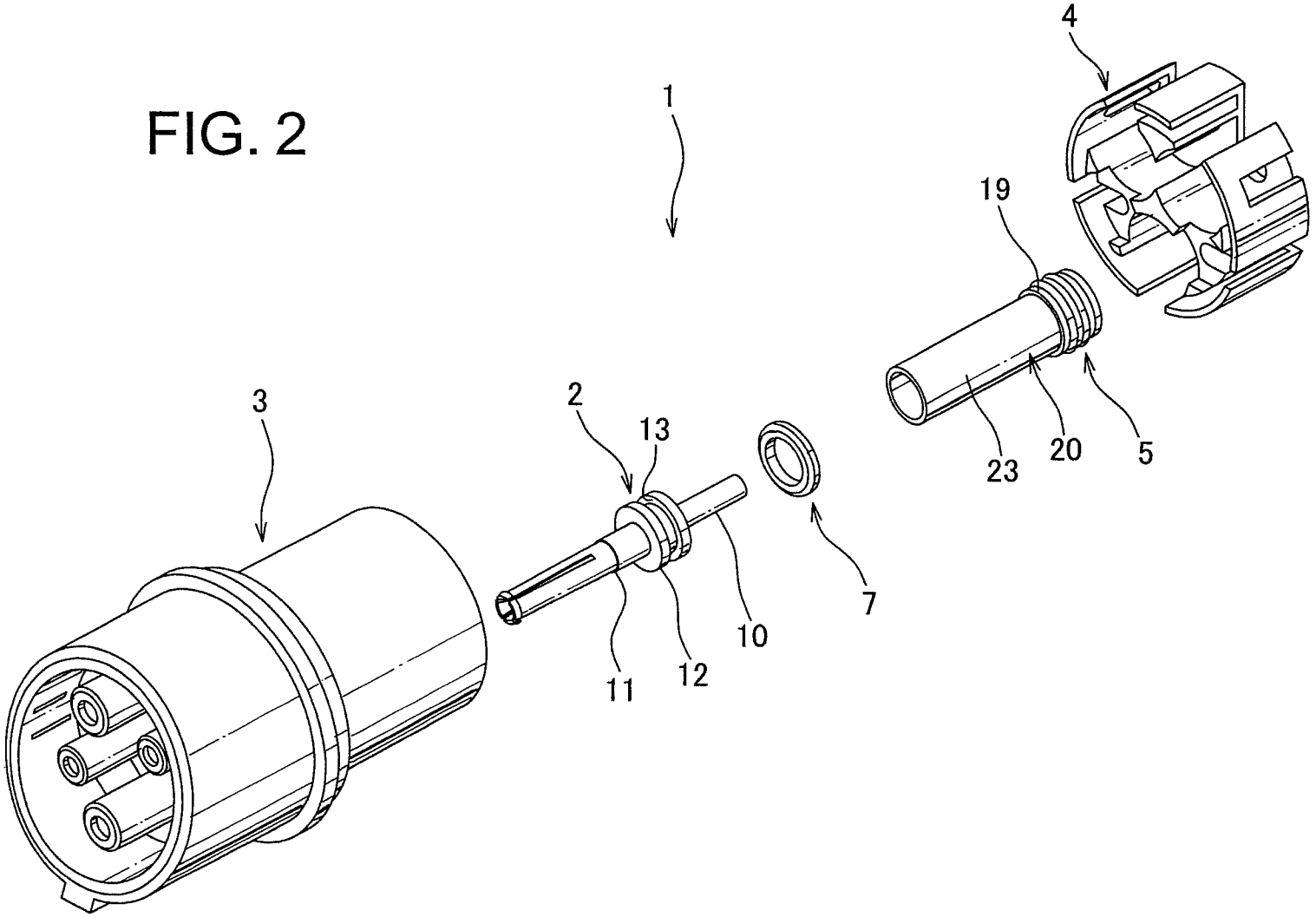
FIG. 2 is an exploded view of the connector shown in FIG. 1.

As shown in FIGS. 1 and 2, a connector 1 includes: a plurality of terminals 2; a synthetic-resin-made housing 3 provided with a plurality of terminal receiving chambers 14 respectively receiving the terminals 2; a rear holder 4 attached to an end of the housing 3 to prevent the terminals 2 from falling out of the terminal receiving chambers 14; a plurality of rubber plugs 5 respectively pressed into the terminal receiving chambers 14; and a plurality of packing 7 (corresponding to the second packing in claims) respectively attached to the terminals 2. Further, in FIGS. 1 and 2, only ones of the terminals 2, the rubber plugs 5, and the packings 7 are shown, and the others are omitted.

The terminal 2 is made of conductive metal. The terminal 2 is provided with a cylinder-shaped electric contact portion 11 configured to be connected with a terminal of a not-shown mating connector, and a wire connecting portion 10 connected to a core wire 9 of an electric wire 8. Further, the wire connecting portion 10 is provided with a ring-shaped flange portion 12 projected from an outer peripheral wall of the wire connecting portion 10 and allowed to abut on a step wall 17 formed on the terminal receiving chamber 14. Further, the electric contact portion 11, the wire connecting portion 10, and the flange portion 12 are arranged coaxially. Further, the electric wire 8 is a circular-sectional-shaped round electric wire having the core wire 9 and an insulating cover.

The electric contact portion 11 is elastically deformable to allow inner and outer diameters to be expanded and contracted. When the terminal of the mating connector is inserted into an inside of the electric contact portion 11, and the electric contact portion 11 is elastically deformed, the electric contact portion 11 is electrically connected to the terminal of the mating connector.

When the core wire 9 of the electric wire 8 is inserted into an inside of the wire connecting portion 10, and the wire connecting portion 10 is plastically deformed so that inner and outer diameters are contracted, namely, the wire connecting portion 10 is swaged, the wire connecting portion 10 is electrically connected to the core wire 9 of the electric wire 8. Further, the flange portion 12 is provided on an end of the wire connecting portion 10 near the electric contact portion 11. Further, a groove 13 is provided along a whole outer peripheral wall of the flange portion 12.

Each terminal receiving chamber 14 is a straight extended space. Each terminal receiving chamber 14 is provided with: a first receiving portion 15 receiving the wire connecting portion 10, an end of the electric wire 8 connected to the wire connecting portion 10, and the rubber plug 5 attached to an outer periphery of the electric wire 8; a second receiving portion 16 continued to the first receiving portion 15 and receiving the electric contact portion 11; and a step wall 17 formed between the first receiving portion 15 and the second receiving portion 16. Sectional shapes of the first receiving portion 15 and the second receiving portion 16 are circular. Further, an inner diameter of the second receiving portion 16 is smaller than an inner diameter of the first receiving portion 15 and an outer diameter of the flange portion 12. Further, a connector housing of a not-shown mating connector is fitted with a left end of the housing 3 in FIG. 1.

The rear holder 4 is attached to an end of the housing 3 at a side away from the mating connector. The rear holder 4 is provided with a plurality of through-holes 18 each through which the electric wire 8 attached to the terminal 2 is inserted.

Figure 4:
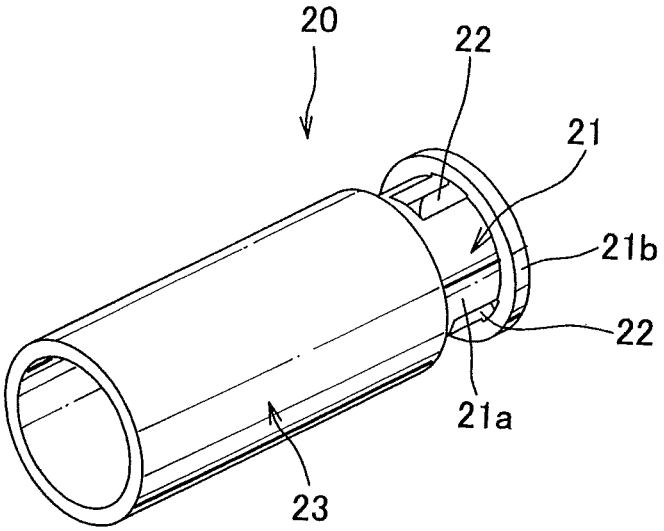
FIG. 4 is a perspective view showing a resin member as a component of a rubber plug shown in FIG. 1.

As shown in FIGS. 1 and 4, the rubber plug 5 is composed of a ring-shaped packing 19 attached to an outer periphery of the electric wire 8 and keeping a space between an outer peripheral wall of the electric wire 8 and an inner wall of the first receiving portion 15 watertight, and a cylinder-shaped resin member 20. The packing 19 is made of elastically deformable synthetic resin such as gum. The resin member 20 is made of synthetic resin which is harder than the packing 19 and hardly elastically deformable.

The resin member 20 is provided with a buried portion 21 a part of which is buried in the packing 19, and a cylinder portion 23 extended in a cylindrical shape from the buried portion 21 made by insert molding. Namely, the buried portion 21 is provided with a cylinder-shaped buried portion main body 21*a* continued to the cylinder portion 23, and a flange portion 21*b* continued to an end of the buried portion main body 21*a* away from the cylinder portion 23, and the buried portion main body 21*a* is buried in the packing 19. Further, the cylinder portion 23, the buried portion main body 21*a*, and the flange portion 21*b* are arranged coaxially. Further, an outer diameter of the buried portion main body 21*a* is smaller than outer diameters of the cylinder portion 23 and the flange portion 21*b*. Further, the buried portion main body 21*a* is provided with a plurality of through-holes 22.

This rubber plug 5 is pressed into the first receiving portion 15 in a manner that the cylinder portion 23 is interposed between the flange portion 12 and the packing 19. In this condition, the wire connecting portion 10 and an end of the electric wire 8 are positioned at an inside of the cylinder portion 23, and a tip of the cylinder portion 23 abuts on the flange portion 12. Further, in this condition, the flange portion 12 abuts on the step wall 17, and the packing 19 abuts on the rear holder 4.

Preferably, in the connector 1 of this invention, the flange portion 12 abuts on the step wall 17, and the packing 19 abuts on the rear holder 4 as described above. However, small gaps may be generated between the flange portion 12 and the step wall 17, and between the packing 19 and the rear holder 4 due to size variations of the components within a range of tolerance.

Figure 5:
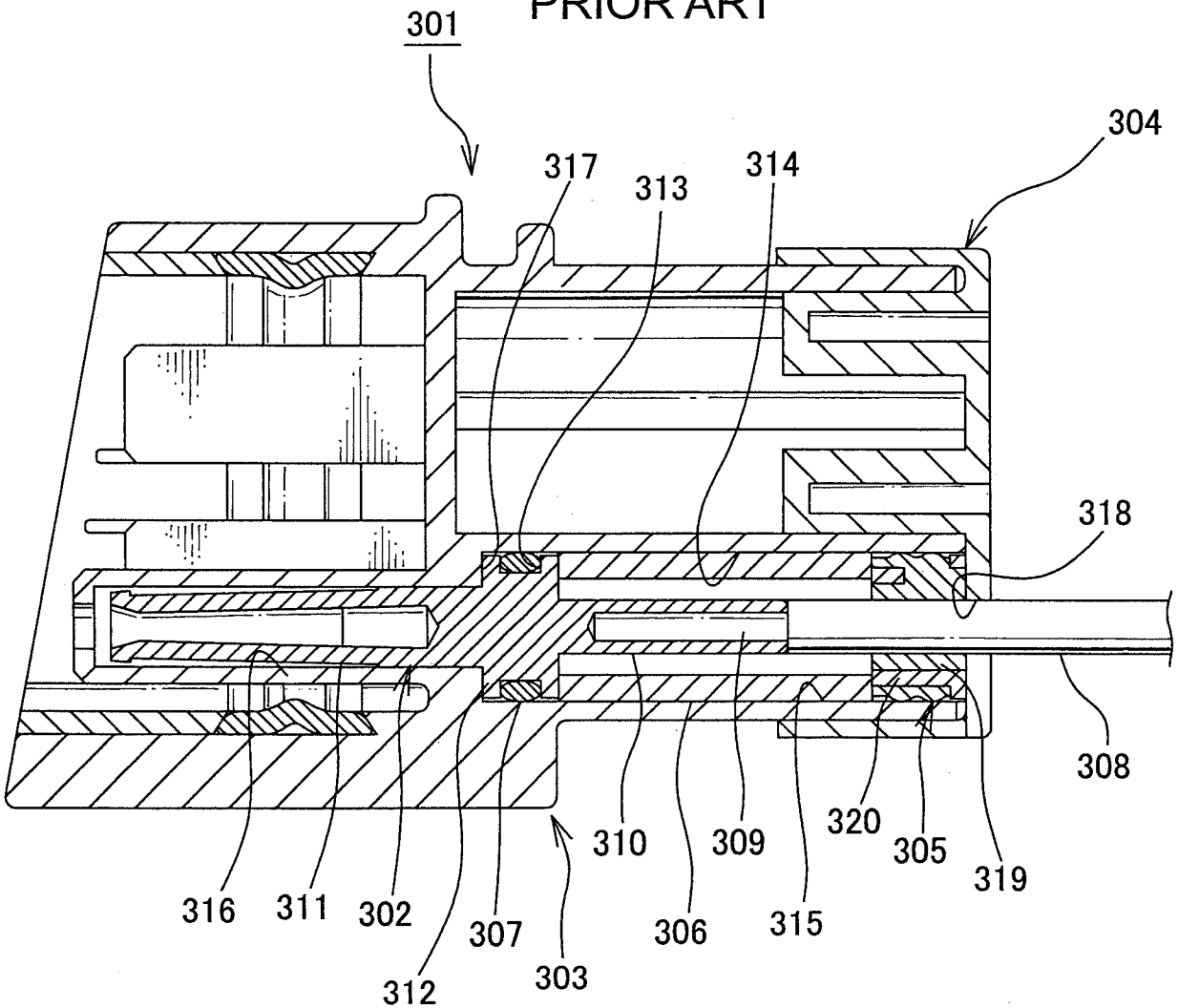
FIG. 5 PRIOR ART
FIG. 5 is a sectional view showing a conventional connector.
Figure 6:
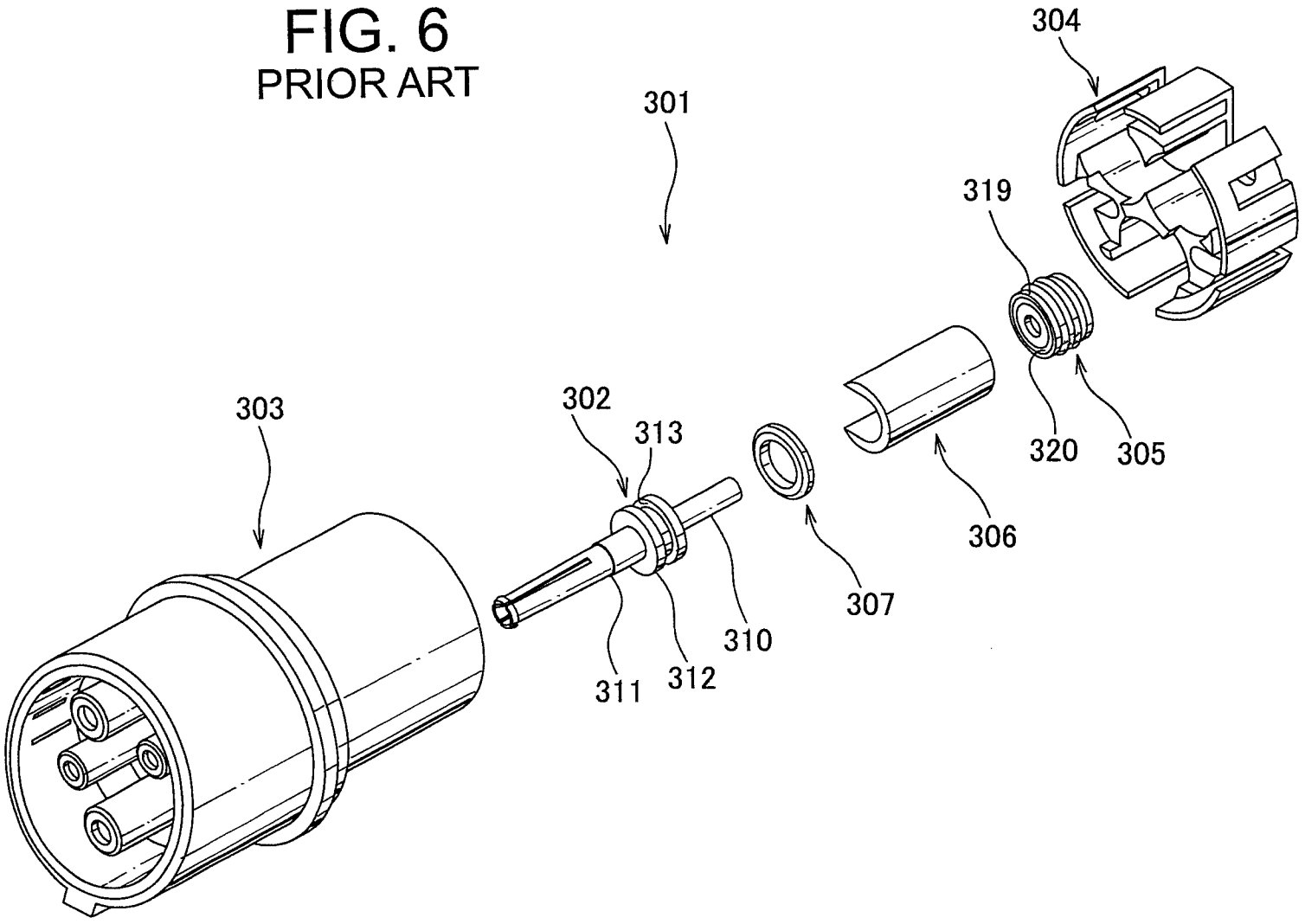
FIG. 6 PRIOR ART
FIG. 6 is an exploded view showing the connector shown in FIG. 5.
Figure 7:
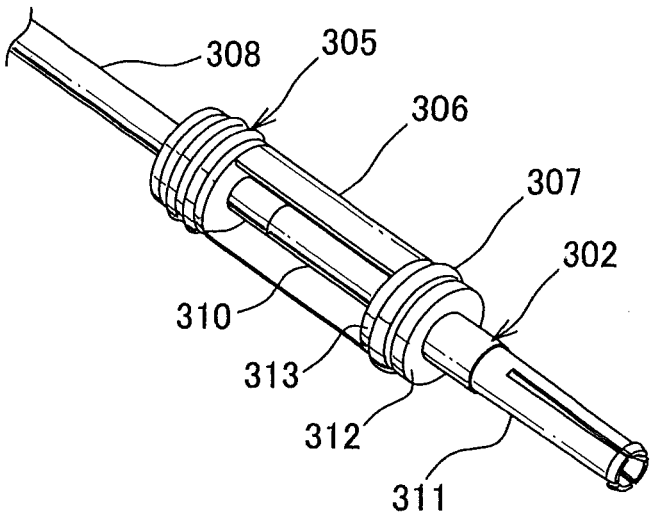
FIG. 7 PRIOR ART
FIG. 7 is a perspective view showing a terminal and the like of the connector shown in FIG. 5.

The cylinder portion 23 works as the same function as the spacer used in the conventional connector (see FIGS. 5 to 7). Namely, in this connector 1, the terminal 2 can be fixed to the housing 3 by the flange portion 12 abutting on the step wall 17 of the terminal receiving chamber 14 and by the cylinder portion 23 without providing a locking arm locked with the terminal 2 on the housing 3. Owing to such a structure, the housing 3 can be downsized.

The packing 7 is made of elastically deformable synthetic resin such as rubber, and formed in a ring shape. The packing 7 is attached to the flange portion 12 in a manner that the packing 7 is received in the groove 13. This packing 7 keeps an outer peripheral wall of the flange portion 12 and an inner wall of the first receiving portion 15 watertight.

Figure 3:
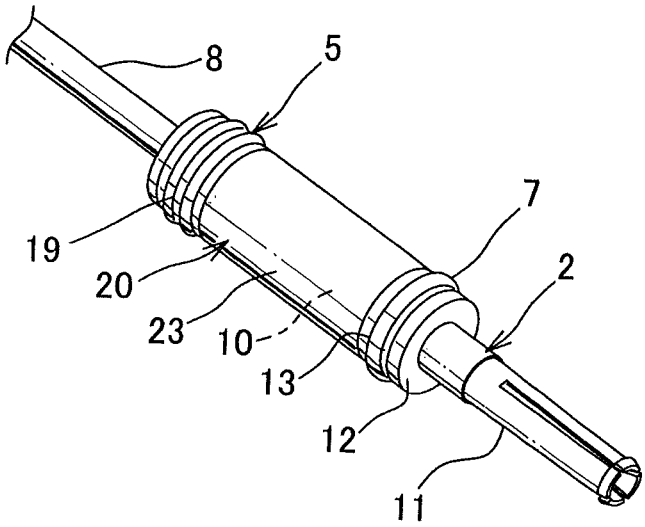
FIG. 3 is a perspective view showing a terminal and the like of the connector shown in FIG. 1.

The connector 1 having the above described structure is assembled as follows. First, the packing 7 is attached to the terminal 2, and the electric wire 8 is inserted through an inside of the rubber plug 5. Then, the core wire 9 of the electric wire 8 is inserted into the wire connecting portion 10, and the wire connecting portion 10 is swaged to attach the electric wire 8 to the terminal 2. This condition is shown in FIG. 3. Then, the rubber plug 5 is shifted to the flange portion 12 side so that the tip of the cylinder portion 23 abuts on the flange portion 12. Then, these terminal 2, packing 7, rubber plug 5 and electric wire 8 are inserted into the terminal receiving chamber 4. Then, the rear holder 4 is attached to the housing 3. Thus, the connector 1 is assembled. This assembled connector 1 is fitted with the mating connector, and works as a component of the wiring harness routed in a vehicle.

In such a connector 1, because the cylinder portion 23 interposed between the flange portion 12 and the packing 19 is integrated with the packing 19, when components are assembled to the housing 3, the cylinder portion 23 is prevented from falling out of a space between the flange portion 12 and the packing 19, and the connector 1 is easy to be assembled. Further, in the conventional connector, a spacer separated from the packing 19 is used corresponding to the cylinder portion 23. In the connector 1, the spacer is not used, and the number of components can be reduced. Further, because of the reduction of the number of components, the production cost can be reduced. Further, in the connector 1, because the number of components is small, not only the assembling workability but also disassembling workability can be improved. Further, in the connector 1, the end of the electric wire 8 can be watertight, and the terminal 2 can be fixed to the housing 3 due to the rubber plug 5 and the packing 7.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

REFERENCE SIGNS LIST

1 connector
2 terminal
3 housing
4 rear holder
5 rubber plug
8 electric wire
10 wire connecting portion
11 electric contact portion
12 flange portion
14 terminal receiving chamber
15 first receiving portion
16 second receiving portion
17 step wall
19 packing
20 resin member
21 buried portion
23 cylinder portion

The invention claimed is:

1. A connector comprising: a terminal; a housing provided with a terminal receiving chamber for receiving the terminal;

a rear holder attached to an end of the housing to prevent the terminal from falling out of the terminal receiving chamber; and a rubber plug pressed into the terminal receiving chamber, wherein the terminal is provided with an electric contact portion connected to a mating terminal, and a wire connecting portion connected to an electric wire, wherein the terminal receiving chamber is provided with: a first receiving portion receiving the wire connecting portion, an end of the electric wire connected to the wire connecting portion, and the rubber plug; a second receiving portion continued to the first receiving portion; and a step wall formed between the first receiving portion and the second receiving portion, wherein the wire connecting portion is provided with a flange portion projected from an outer peripheral wall of the wire connecting portion and allowed to abut on the step wall, wherein the rubber plug is composed of a ring-shaped packing attached to an outer periphery of the electric wire and keeping a space between an outer peripheral wall of the electric wire and an inner wall of the first receiving portion watertight, and a resin member, wherein the resin member is provided with a buried portion, a cylinder portion extended in a cylindrical shape from the buried portion made by insert molding, and a second flange portion at an end of the buried portion opposite the cylinder portion, wherein the buried portion includes a cylindrical main body axially offset from and radially inward of the cylinder portion, and defines an annular recess configured to receive the packing between the cylinder portion and the second flange portion, and wherein the cylindrical main body of the buried portion defines a plurality of through-holes.

2. The connector as claimed in claim 1, further comprising:

a second packing attached to an outer peripheral wall of the flange portion of the wire connecting portion, and keeping a space between the outer peripheral wall of the flange portion and the inner wall of the first receiving portion watertight.

* * * * *